United States Patent [19]

Ernst et. al

[11] Patent Number: 4,990,861

[45] Date of Patent: Feb. 5, 1991

[54] ELECTRON ACCELERATOR OF THE MICROTRON TYPE

[75] Inventor: Gerardus J. Ernst, Losser, Wilhelmus J. Witteman, Hengelo, both of the Netherlands.

[73] Assignee: Ultra-Centrifuge Nederland N.V., Almelo, Netherlands

[21] Appl. No.: 306,067

[22] Filed: Feb. 6, 1989

[30] Foreign Application Priority Data

Feb. 10, 1988 [NL] Netherlands ..... 8800328

[51] Int. Cl.[5] ..... H05H 13/00

[52] U.S. Cl. ..... 328/233; 328/230

[58] Field of Search ..... 328/233, 234, 230, 235; 313/62

[56] References Cited

U.S. PATENT DOCUMENTS 2,943,265 6/1960 Kaiser ..... 328/234

3,382,391 5/1968 Reich ..... 328/234

FOREIGN PATENT DOCUMENTS 898628 1/1982 U.S.S.R. ..... 328/233

OTHER PUBLICATIONS

Luganskii; Microtron with Helical Orbits; Apr. 1971, pp. 1743–1744.

*Primary Examiner*—Donald J. Yusko

*Assistant Examiner*—Michael Horabik

*Attorney, Agent, or Firm*—Cushman, Darby & Cushman

[57] ABSTRACT

An electron accelerator of the microtron type, housing a vacuum chamber with two spaced apart, nearly parallel, flat pole pieces, between which a static, substantially homogeneous magnetic field is maintainable, a microwave resonating cavity interposed between the pole pieces, a source for supplying electrons and injecting them into the accelerator, said electrons moving in circular orbits in a plane parallel to the pole pieces under the influence of the homogeneous magnetic field and undergoing acceleration at each crossing of the microwave resonating cavity, as well as a device for withdrawing the electrons from the accelerator after they have been sufficiently accelerated, said source for injecting electrons ensuring source of electrons through one of the pole pieces, at an angle to the circular orbits of the electrons, and including a deflecting magnet interposed between the pole pieces for deflecting the injected beam into the plane of the circular orbits of the electrons.

4 Claims, 1 Drawing Sheet

ELECTRON ACCELERATOR OF THE MICROTRON TYPE

Figure 1:
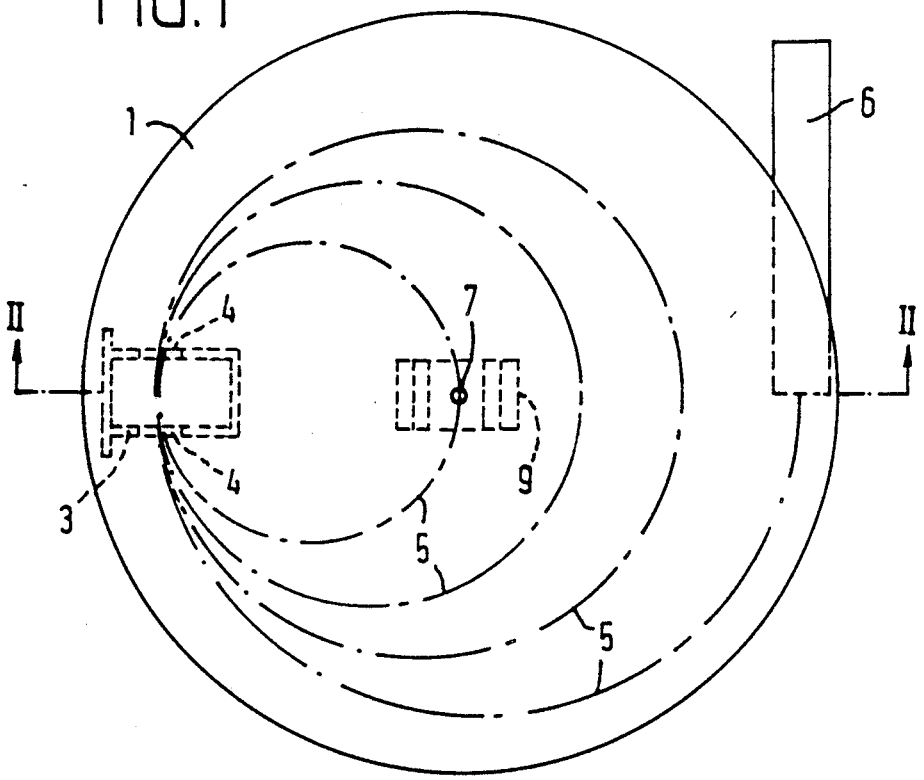

This invention relates to an electron accelerator of the microtron type, comprising a vacuum chamber having two spaced apart, nearly parallel, flat pole pieces, between which a static, substantially homogeneous magnetic field is maintainable, a microwave resonating cavity interposed between the pole pieces in the vacuum chamber, means for supplying electrons and injecting them into the accelerator, said electrons moving in circular orbits in a plane parallel to the pole pieces under the influence of the homogeneous magnetic field and undergoing acceleration at each crossing of the microwave resonating cavity, as well as means for withdrawing the electrons from the accelerator after they have been sufficiently accelerated.

Such an electron accelerator is known from an article in Il Nuovo Cimento, series X, Vol. 68A, pp. 513–545. The electrons injected into the accelerator are accelerated in each turn in the electric field of the microwave resonating cavity so that they move in ever increasing circular orbits. At each acceleration the time required to run such a larger circular orbit increases by an integral number of oscillation times of the microwaves. The above-mentioned article contains an extensive discussion on the connections that should exist between the value of the homogeneous magnetic field, the accelerating voltage across the microwave resonating cavity and the microwave frequency.

In the known electron accelerator of the microtron type the electron injection takes place by means of a hot cathode. Such a hot cathode can be located inside or outside the microwave resonating cavity, preference being given to a location outside the resonating cavity. A problem involved in this method of injecting is that the electron flow that can finally be withdrawn from the microtron is only limited owing to the injection being limited. The injection is limited owing to the fact that there is only a limited space available for the hot cathode and the first accelerating electrode. Enlargement of the cathode, if possible at all, is no solution of the problem, for the electrons emitted by the cathode must be, among other things, exactly directed and have the correct phase. In case of enlargement of the cathode these requirements cannot be satisfied anymore. In case of using a hot electrode it was thus found in practice that a current strength of the electron flow higher than about 120 mA on the average could not be obtained in the macropulse. The accelerator described in the above-mentioned article, for instance, gave a peak current of 60 mA.

Recently, interest has been rearoused for the microtron, which is due to the fact that such an electron accelerator can supply electrons of high energy, in the order of some tens of MeV, having an excellent quality as regards the energy spread and thus being suitable as a generator for an electron beam for use in a so-called free electron laser. A drawback attached to the microtron in that use is that the current strength is moderate.

It is an object of the invention to improve the known microtron in such a way as to obtain a higher current strength of the beam of accelerated electrons to be finally withdrawn from the apparatus.

This object is accomplished according to the invention with an electron accelerator of the microtron type, in which the means for injecting electrons comprise means for injecting an electron beam through one of the pole pieces, at an angle to the circular orbits of the electrons, said electron beam being provided by an external source of electrons, as well as a deflecting magnet interposed between the pole pieces for deflecting the injected beam into the plane of the circular orbits of the electrons.

It is observed that external injection of electrons into a microtron is already described in the article in Instruments and Experimental Techniques, Vol. 24, No. 3, Part 1, May–June 1981, pp. 579–581. This article relates to a proposal for external injection, in respect of which calculations were made. The injection is reported to take place into the resonating cavity near its axis at a tangential angle of about 35° to the first orbit, but in the plane of the circular orbits. It is not known whether the proposal described has ever been realized in practice, but it does not seem improbable that with a process according to this proposal parasitic oscillation modes could be introduced, which is very undesirable.

According to the invention, contrary to the above-mentioned theoretical proposal, the electrons to be accelerated are externally injected through one of the pole pieces of the accelerator. In the place where the injection beam traverses the pole piece this pole piece may be provided with, e.g., a channel. Because the injection beam is directed at an angle, e.g., perpendicularly to the plane of the circular orbits of the accelerated electrons, the beam must be deflected towards that plane. This function is performed by the deflecting magnet.

Since a deflecting magnet interposed between the pole pieces of the apparatus influences the homogeneous magnetic field between the pole pieces, a correction must be made, if necessary, in respect of such influence, for which purpose known per se correction means can be provided. In order to maximally reduce the influence of the deflecting magnet on the homogeneous field, said deflecting magnet is preferably so constructed as to limit the field of said magnet as much as possible to said magnet and its interior. Preferably, the deflecting magnet is further arranged in a position diametrically opposite the microwave resonating cavity in an electron circular orbit.

The deflecting magnet must be arranged in an electron circular orbit in such a way that after deflection the injected electrons are capable of moving in said orbit. Furthermore, the deflecting magnet must not perturb adjacent electron circular orbits. For this reason it could be desirable to arrange the deflecting magnet in a relatively large orbit (great diameter) because with such an orbit the distance to adjacent orbits in the position diametrically opposite the microwave resonating cavity is likewise relatively large so that room is provided for a deflecting magnet of reasonable dimensions. However, the larger the orbit to which there is coupled, the higher must be the energy of the injected electrons, since they must be able to "run along" with a velocity applying to accelerated electrons running in said orbit.

In order to avoid or solve the above described problems, the injection of electrons from the external source must be effected at high energy. The external source employed is, e.g., a linear accelerator supplying electrons having an energy of some tens of keV, coupled to a further accelerator which already accelerates said electrons before injection to the MeV level.

The influence exerted by the deflecting magnet on adjacent electron circular orbits can be further restricted by operating the microtron in a mode higher than the fundamental mode. The fundamental mode is the mode at which the revolution for successive orbits increases by exactly one oscillation time of the microwaves in the microwave resonating cavity. At a higher mode the difference in revolution for successive orbits is two or more oscillation times. In that case the difference in diameter between successive orbits and consequently the distance between said orbits are greater too. Furthermore, the distance between successive orbits can be influenced by appropriate selection of the frequency of the microwaves in the microwave resonating cavity. For a frequency of 1.3 $GH_z$ the distance between the orbits, for instance, is greater than for a frequency of 3 $GH_z$. Of course, a frequency in the microwave range (i.e. with a wavelength in cm) is to be selected.

Furthermore, in the apparatus according to the invention the technique of so-called "bunching" can be advantageously selected. In the use of this technique means are provided for slightly retarding a part of the series of electrons to be injected and slightly accelerating another part thereof, so that after some time so-called bunches of electrons are formed in the beam. Exactly in the case of external injection, as in the microtron according to the invention, such a technique is very useful.

Figure 2:
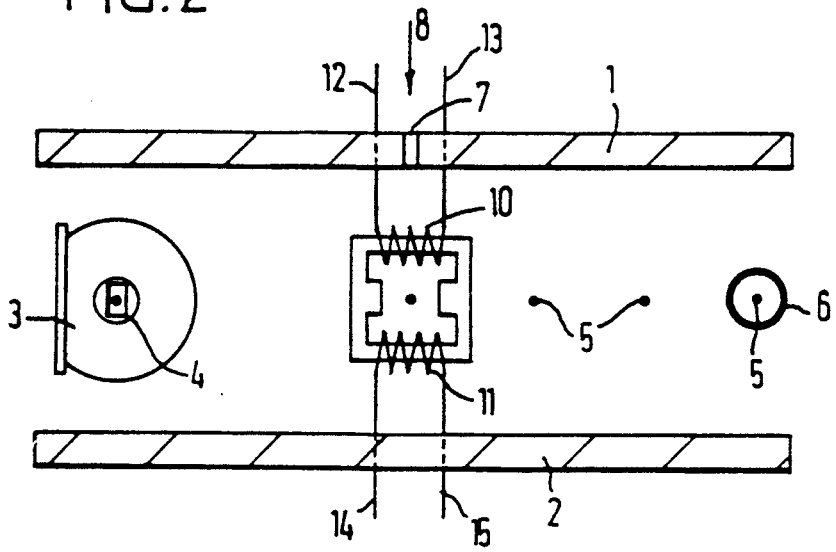

The invention will now be illustrated by way of example with reference to the accompanying drawings, in which FIG. 1 is a schematic top view of the most essential parts of an embodiment of the electron accelerator according to the invention, and FIG. 2 is a cross-sectional view taken along the line II—II through the apparatus as shown in FIG. 1.

In FIGS. 1 and 2 the most essential parts of an embodiment of the microtron according to the invention are very schematically shown. The microtron comprises two spaced apart parallel pole pieces 1 and 2, which are substantially flat and circular. The pole pieces 1 and 2 are arranged in a vacuum chamber (not shown).

Interposed between the pole pieces 1 and 2 is a microwave resonating cavity 3. The microwave resonating cavity 3 is of a construction known per se and may be, e.g., a hollow body provided with corrugated tubes. In the microwave resonating cavity 3, e.g., oscillations are generated having a frequency in the order of some $GH_z$, i.e. with a wavelength of, e.g., about 10 cm. Windows 4 allow the passage of electrons moving around in the accelerator through the microwave resonating cavity 3. When the electrons arrive in the microwave resonating cavity 3 at the correct phase, they are accelerated therein by the electric field, so that they will then move in a circular orbit in the microtron under the influence of the prevailing magnetic field, said circular orbit having a diameter larger than the orbit in which they moved before the acceleration. If the electrons always arrive in the microwave resonating cavity 3 at the correct phase, they will constantly be accelerated further and move in increasing circular orbits (shown in the figures with broken lines and with points 5, respectively). At the outermost circular orbit the electrons are finally withdrawn from the microtron through the tube 6.

The construction of the microtron, the microwave resonating cavity 3 and the discharge tube 6 and the operation of same are known, e.g., from the above-mentioned article in Il Nuovo Cimento.

What is novel in the apparatus according to the invention is the method of injecting electrons into the apparatus. According to the invention this is effected by introducing an electron beam created outside the apparatus with an external accelerator, e.g., a linear accelerator, between the pole pieces 1 and 2 at an angle to the plane of the circular orbits via an appropriate channel 7 in pole piece 1. The beam introduced is indicated in FIG. 2 by the arrow 8.

Interposed between the pole pieces 1 and 2, at the place where the beam 8 enters the space, is a deflecting magnet 9 which deflects the beam 8 so that it will extend in the plane of the circular orbits 5 and move in such a circular orbit 5 by the action of the magnetic field. The deflecting magnet 9 is rather schematically shown and comprises, among other things, two magnet coils 10 and 11 which are fed via lines 12 and 13, and 14 and 15, respectively, extending to outside the pole pieces 1 and 2 where they are connected to sources of current (not shown). The electron beam 8 must comprise electrons accelerated in such a way that after deflection by the magnet 9 the electrons will move in such a circular orbit 5 that they pass through the microwave oscillating cavity 3 and are further accelerated by said microwave resonating cavity 3.

The beam 8 is suitably introduced into the microtron at a place located on a circular orbit 5, preferably diametrically opposite the microwave resonating cavity 3. The distance to a next circular orbit 5 should then be such that the deflecting magnet 9 does not intersect or otherwise perturb the next circular orbit 5. A skilled worker will further be able to conceive appropriate correction means for reversing as much as possible the perturbation of the homogeneous magnetic field between the pole pieces 1 and 2 by the deflecting magnet 9. That perturbation is as low as possible if the deflecting magnet 9 is suitably constructed so that the field of said deflecting magnet is substantially concentrated within the magnet and the magnetic material is used in an amount such that the field between the pole pieces 1 and 2 is hardly perturbed.

We claim:

1. An electron accelerator of the microtron type, comprising a vacuum chamber having two spaced apart, nearly parallel, flat pole pieces, between which a static, substantially homogeneous magnetic field is maintainable, a microwave resonating cavity interposed between the pole pieces in the vacuum chamber, means for supplying electrons and injecting them into the accelerator, said electrons moving in circular orbits in a plane parallel to the pole pieces under the influence of the homogeneous magnetic field and undergoing acceleration at each crossing of the microwave resonating cavity, as well as means for withdrawing the electrons from the accelerator after they have been sufficiently accelerated, characterized in that the means for injecting electrons comprise means for injecting the electrons through one of the pole pieces, at an angle to the circular orbits of the electrons, injecting an electron beam provided by an external source of electrons, as well as a deflecting magnet interposed between the pole pieces for deflecting the injected beam into the plane of the circular orbits of the electrons.

2. An electron accelerator as claimed in claim 1, characterized in that the deflecting magnet is so constructed as to limit the field of said magnet as much as possible to said magnet and its interior.

3. An electron accelerator as claimed in claim 1, characterized in that the deflecting magnet is arranged in a position diametrically opposite the microwave resonating cavity in an electron circular orbit.

4. An electron accelerator as claimed in claim 1, characterized in that the means for supplying the electrons to be injected are provided with means for slightly retarding the foremost electrons of series of electrons and slightly accelerating the hindmost electrons so as to obtain relatively compact electron bunches.

* * * * *